United States Patent [19]

Blaul

[11] Patent Number: 4,561,903

[45] Date of Patent: Dec. 31, 1985

[54] METHOD OF SOLVENT SPRAY CLEANING IN AN ENCLOSED CHAMBER

[75] Inventor: Ronald L. Blaul, Crystal Lake, Ill.

[73] Assignee: Trigent, Inc., McHenry, Ill.

[21] Appl. No.: 672,145

[22] Filed: Nov. 16, 1984

Related U.S. Application Data

[60] Continuation of Ser. No. 410,589, Aug. 23, 1982, abandoned, Division of Ser. No. 275,965, Jun. 22, 1981, Pat. No. 4,433,698.

[51] Int. Cl.[4] ..... B08B 3/02

[52] U.S. Cl. ..... 134/10; 55/385 R; 98/115.3; 134/18; 134/104; 134/111; 134/113; 134/200

[58] Field of Search ..... 134/10, 56 R, 102, 104, 134/110, 111, 200, 18, 113; 55/385 R; 98/115.3

[56] References Cited

U.S. PATENT DOCUMENTS

| | | | |
|---|---|---|---|
| 2,208,646 | 8/1940 | Saunders et al. | 134/104 X |
| 2,576,008 | 11/1951 | Gladfelter | 51/8 |
| 2,797,530 | 7/1957 | Garver | 51/8 |
| 3,416,544 | 12/1968 | Paiva | 134/102 |
| 3,542,592 | 11/1970 | Zweig | 134/1 |
| 3,971,394 | 7/1976 | Osborne | 134/111 X |
| 4,052,227 | 10/1977 | Delo et al. | 134/56 R |
| 4,098,225 | 7/1978 | Norman | 134/104 X |
| 4,101,340 | 7/1978 | Rand | 134/11 |
| 4,170,488 | 10/1979 | Norman | 134/10 |

FOREIGN PATENT DOCUMENTS

| | | |
|---|---|---|
| 2323552 | 11/1974 | Fed. Rep. of Germany . |
| WO80/01983 | 10/1980 | PCT Int'l Appl. . |

*Primary Examiner*—Marc L. Caroff

*Attorney, Agent, or Firm*—John W. Gaines

[57] ABSTRACT

High pressure washing method utilizing a hand directed spray nozzle for cleaning parts, by eye through a viewing window, and an enclosing chamber containing the parts in a manner whereby the zone for solvent spray by the nozzle is closely confined within the enclosure so as not to expose the operator or the outside environment to the liquid runoff of the solvent, or to the sprayed particles thereof, or to solvent steam or rising vapors. With a view to ecology considerations, and in addition to the concern to confine the contaminant from escaping into the environment, the internal air of the chamber and all solvent are continually recycled for re-use according to the washing procedure. Such procedure entails, in the practice of the instant invention, keeping down the vapor concentration by defogging the chamber air, and simultaneously defogging the viewing window through blanketing same by the defogged air as recycled.

13 Claims, 11 Drawing Figures

FIG. 1
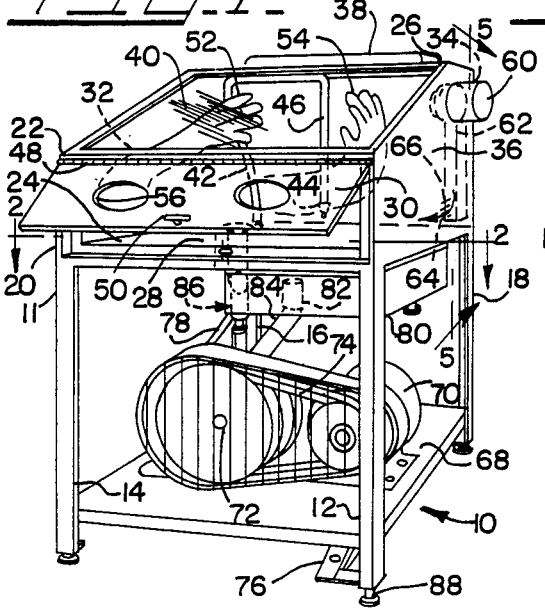
FIG. 5
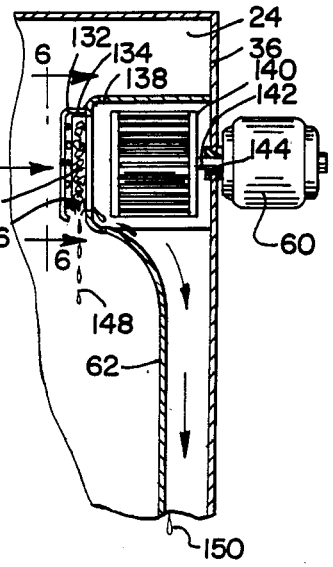
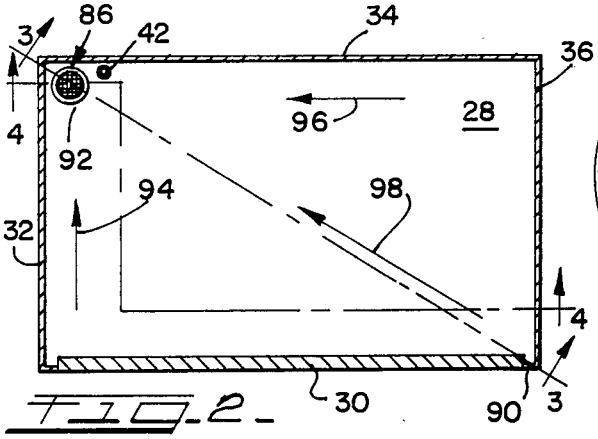
FIG. 2
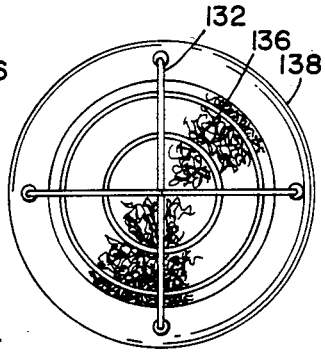
FIG. 6
FIG. 3
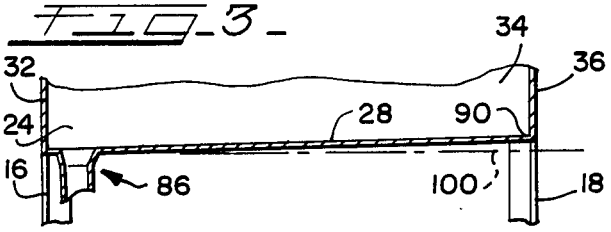

W
P

METHOD OF SOLVENT SPRAY CLEANING IN AN ENCLOSED CHAMBER

This application is a continuing case of Ser. No. 410,589, filed Aug. 23, 1982, now abandoned which is a division of Ser. No. 275,965, filed June 22, 1981, now Pat. No. 4,433,698 relating to cleaning apparatus.

The invention hereof relates to a cleaning method employing a high pressure liquid spray of solvent. It relates more particularly to the washing, by eye through a viewing window, of parts under high pressure by means of a hand directed spray nozzle, and an enclosing chamber containing the parts in a manner whereby the spraying zone in which the parts are sprayed by the nozzle is closely confined within the enclosure so as not to expose the operator or the outside environment to the liquid runoff of the solvent, or to the sprayed particles thereof, or to solvent steam or rising vapors. The internal atmosphere of the chamber is restricted thereby to its same closed confines as the spraying zone, such that preventing escape of both atmosphere and solvent enables recovery of all of the air and all of the solvent so as to be continually recycled and re-used, without being lost to some extent to the outside and, undesirably so, introducing thereto contamination to that extent. Such desiderata entail, as will be seen according to the practice of my invention, both keeping down the vapor concentration by defogging the chamber air, and simultaneously defogging the viewing window through blanketing same by the defogged air as recycled.

The concern to prevent atmospheric and other environmental pollution and to conserve natural resources by continual re-use of the internal atmosphere and all solvent is especially important because of ecology considerations.

Washing methods in accordance with practice in the past have, for instance, involved such machines as are utilized by the repair man who frequently washes parts, an automobile mechanic, for example, and they provide an open front for his ready accessibility with his washing, also a hand brush, and a slow running, steady, solid, large stream usually of a petroleum solvent with which he rinses off a part after brushing, if necessary. The rinse-off is manual, accomplished by directing a hose-carried hand nozzle provided on the parts washer, and the rinse solvent is continually filtered and admitted to a pump on the machine for constant re-use by being recirculated back to the hand nozzle. By reason of convenience and expediency, it is therefore the practice for the repair man to wash parts openly in the washer and usually bare-handed and in no way protecting his skin surfaces, clothing, and breathing from the drawback of direct exposure to solvent stream, splash, and air-borne fumes, and in no way protecting outside surroundings to the washer from that same drawback.

It is an object of the present parts washing invention to materially reduce or substantially eliminate the foregoing drawback, and other disadvantages of parts washing as just described. Of lesser analogy to this washing procedure for the repair man, some background patents which can be noted include, along with the publication Abstract Number PCT/CH80/00029 priority date 3/26/79 published 10/2/80 disclosing a washer for hands with air recirculation of relevance, a certain U.S. Pat. No. 4,170,488 disclosing a continuous parts washer with cleaner and air recycling of relevance, and most especially the two Gladfelter U.S. Pat. No. 2,576,008 disclosing a glass-fronted sluriator with glove box gloves, a blast gun nozzle, and an exhaust blower of relevance, and Rand U.S. Pat. No. 4,101,340 disclosing a nail degreaser and drier chamber with air exhausting in part in its path by blowing directly out into the atmosphere and flowing in part in an air recirculation path of relevance.

It is another object, in connection with the air path followed by the chamber atmosphere's closed cycle and with the liquid path followed by the solvent's closed cycle, for the two paths to have a common portion beginning intermediate the nozzle and the part to be spray cleaned, completely enclosed by the enclosure with substantially complete integrity, and accommodating crossover of solvent vapor from the liquid path into the air path of the chamber atmosphere. The vapor, in joining the air path, is entrained in the moving air.

An additional object, in line with the immediately preceding objective, is that the atmosphere's closed cycle path is provided as a blower-forced path of recirculation for recycling the internal air of the chamber and including a vapor-to-liquid agglomerating filter on the upstream side of the internal air blower which admits, separates from its atmospheric entrainment, and agglomerates as a liquid, the crossover vapor.

A further object, in line with the foregoing objectives, is that the solvent's closed cycle path is provided as a pump-forced path of recirculation for recycling all solvent runoff as ultimately rejoined by the liquid agglomerate.

Another object, in line with the above objective of a blower-forced path and more particularly with how it is produced, is the provision of a blower-recirculated atmosphere recycling circuit effective to limit and dilute the vapor to a reduced concentration by vapor-to-liquid agglomeration thereof in the filter and by reintroduction of the vapor-ridded air, when recycled, for continued circulation within the closed confines of the spray chamber.

It is an additional object, in line with the immediately preceding objective of the blower-recirculated atmosphere recycling circuit, to provide a blower tower containing the air-forcing blower, and having an inlet and outlet arranged with the filter in the inlet; a recycled-air deflector provided in the outlet and a viewing window provided in the chamber establish cooperation to aid the eye of the mechanic by the deflector directing the forced-pressure re-introduced, de-saturated recycled air in a path sweeping across the window on its inside surface, to prevent fogging from any solvent vapor which might otherwise deposit itself across the area of transparency.

Another object in the special case of a flammable solvent is to provide, between the chamber continually discharging solvent runoff and a usual solvent collecting tank communicating by drain from the chamber, a heat-actuated plug sensitive to the solvent being set afire in the chamber to thereupon automatically block the drain and seal off the tank of solvent from further communication with the chamber.

A further object in achieving my washing procedure is to provide a washer to carry out the procedure comprising a vertically disposed stand, and a washing machine proper arranged atop the stand with the machine's floor pan supported thereon, the arrangement being such that feet provided on the stand afford a floor adjustment placing the stand a desired amount out of true vertical so that the floor pan in the washing machine stays just atilt enough for rapid runoff of solvent therefrom with no chance of accumulation in case the solvent is ignited in the spray chamber of the machine.

Further features, objects, and advantages will either be specifically pointed out or become apparent when, for a better understanding of my invention, reference is made to the following description taken in conjunction with the accompanying drawings which show certain preferred embodiments thereof and in which:

FIG. 1 is an isometric view of the washer as fully assembled, with a floor stand therefor and a cleaning machine atop the stand and embodying the blower tower thereof and other principles of the present invention;

FIG. 2 is a section, in plan view, of the machine's floor pan as taken along the section line 2—2 of FIG. 1;

Figures 4, 7, 8, 9:
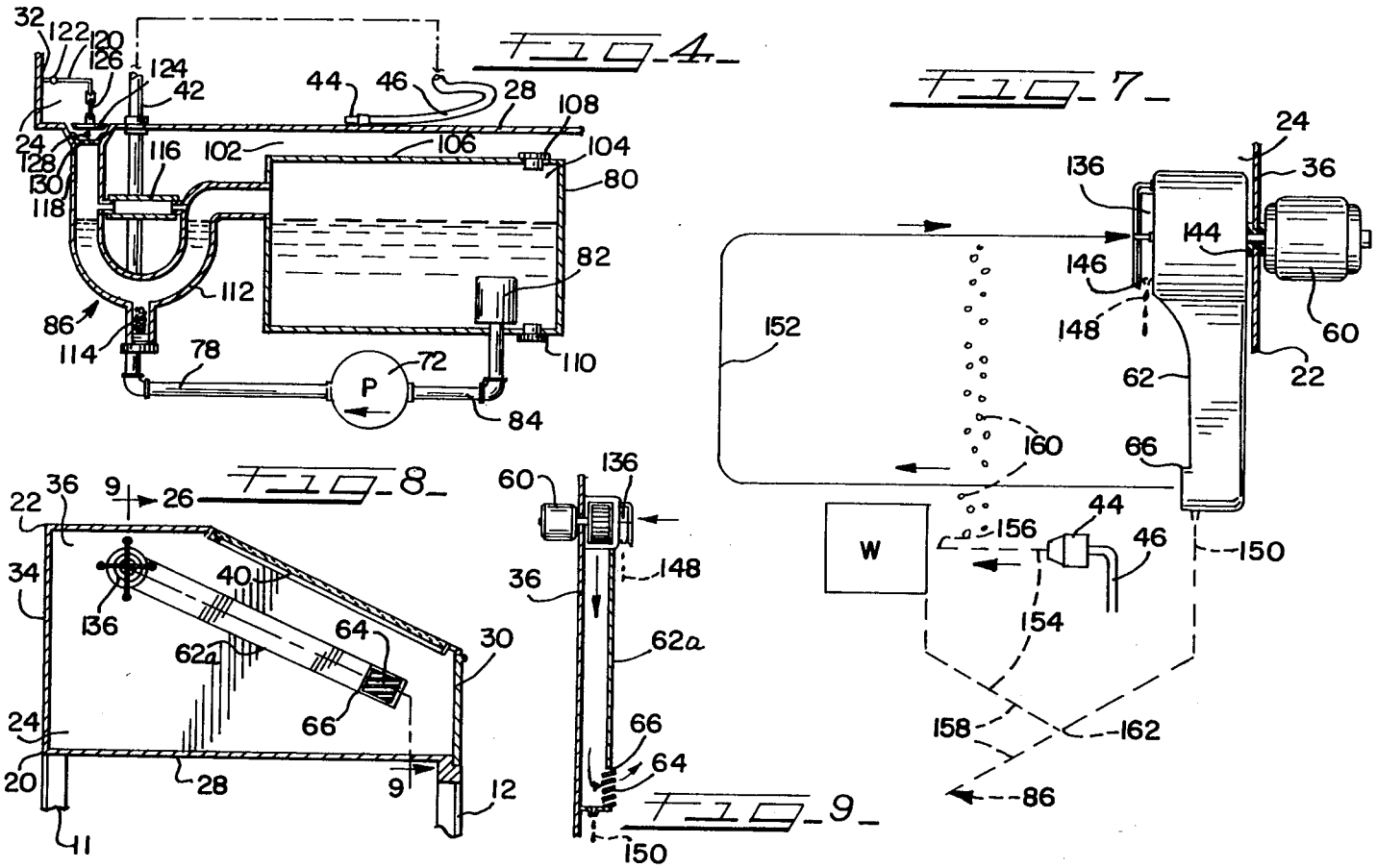
Figure 10:
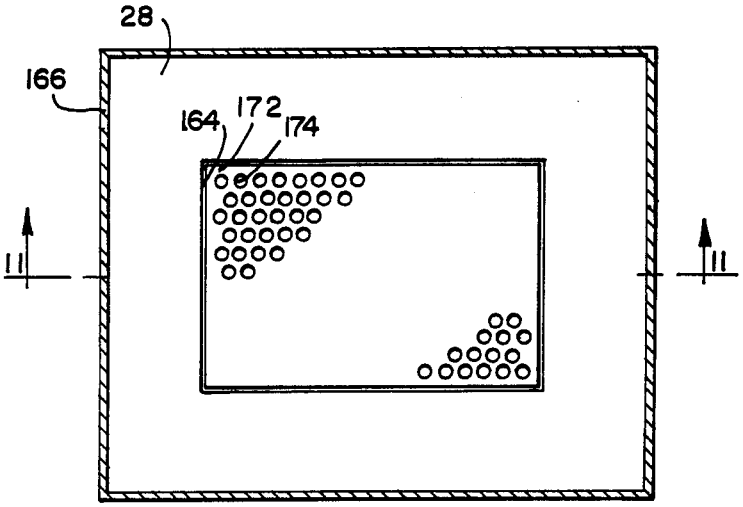
Figure 11:
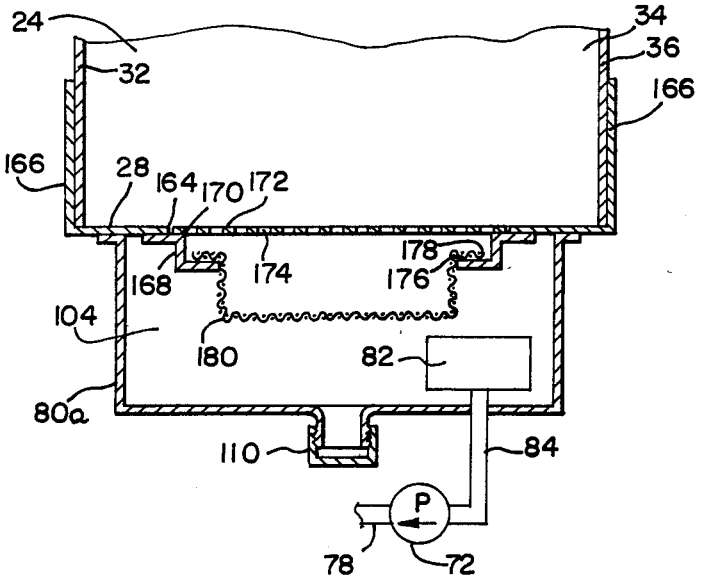

FIGS. 3 and 4 are cross sectional views in front elevation of the floor pan as taken along the section lines 3—3 and 4—4, respectively, of FIG. 2;

FIG. 5 is a cross sectional, front elevational detail showing the blower tower in vertical disposition and taken along the section line 5—5 of FIG. 1;

FIG. 6 is an elevational face view of the inlet filter carried by the blower tower, as viewed in the direction indicated by the section line arrows 6—6 in FIG. 5;

FIG. 7 is similar to FIG. 5, but is further supplemented with schematic additions indicating solvent spray crossover joining the closed path of circulation of air by the blower tower, and indicating agglomerate crossover joining the closed path of pumped solvent circulation as soon as the air path loses its entrained vapor being filtered out and agglomerated in the tower;

FIG. 8 is similar to FIG. 6, additionally thereto showing a near-horizontal tower modification of the invention in more complete detail and being supplemented for further details by FIG. 9 as taken along the diagonally-run cross sectional lines 9—9 in FIG. 8; and FIG. 10 is similar to FIG. 2, additionnally thereto showing a modification of the invention in more complete detail and being supplemented for further details by FIG. 11 in front elevation as taken along the section line 11—11 in FIG. 10.

More particularly in the drawings, a high pressure washer 10 is shown in FIG. 1 having a floor stand 11 supported on four legs 12, 14, 16, and 18 and supporting the machine 20 for cleaning parts. The machine has a six-sided, vapor confining cabinet 22 affording a fully enclosed spray chamber 24 therein and including, along with the spaced apart sealed top wall 26 and floor pan wall 28, a continuous series of side walls 30, 32, 34, and 36 joining same for totally confining the air contents contained by the chamber 24.

The top wall 26 carries a light fixture 38 equipped with a straight fluorescent tube so the operator can illuminate the work in the chamber 24. A transparent plastic window inset of Plexiglas, for instance, or else plate or window glass 40 set at a console angle in the top wall 26 gives the operator a clear view inside. A high pressure hose 42 which passes through the inside of the chamber 24 is secured at about the middle of the underside of the top wall 26 so as to supply a spray nozzle 44 carried at a free swinging, depending terminal portion 46 of the hose 42.

The side wall 30 at the front side consists of a sealed door secured by a horizontally disposed piano hinge 48 at the top edge so as to open outwardly and upwardly to admit work to the chamber 24. A doorhandle 50 at the bottom controls a lock carried by the door to keep it tight against the door opening seals when closed. Left and right, leak-proof glove box gloves 52 and 54 are in the chamber sealed to the inside of hand holes 56 and 58 in the door allowing the operator access for his hands and forearms into the chamber 24 at a point below the viewing window. The operator keeps completely dry because of the door and because of the sealed off, impervious gloves 52 and 54, he being actually forced into wearing the protective gloves.

The side wall 36 which is at the right end of the cabinet 22 as viewed in FIG. 1 carries on the outside at the top an electrical blower motor 60 and, on the inside starting at the top, carries a vertically disposed blower tower 62. The tower 62 affords continuous internal circulation of the chamber atmosphere, and it reintroduces the atmosphere by discharging same into the chamber downwardly and laterally through deflector vanes 64 in a side outlet 66 at the bottom of the tower.

The stand legs 12, 14, 16, and 18 support, at a slight distance above the floor, a generally horizontal base platform 68. The platform 68 has bolted thereto a switchoperated electric motor 70 and a driven, high pressure pump 72 connected thereto by a V-belt drive 74. The motor 70 is operated by a switch pedal 76 which frees the hands of the operator by affording him foot control to start and stop the spray cleaning operation.

More specifically, a high pressure conduit 78 interconnects the outlet of the pump 72 and a hose fitting to the spray nozzle hose 42 positioned in chamber 24 and, after the operator directs the nozzle 44 at a part to be cleaned, he presses down on the switch pedal 76 and the nozzle starts spraying.

In some applications contemplated, the pump can draw cleaning liquid from a plastic reservoir tank carried by the base platform 68. As illustrated in FIG. 1 however, a reservoir tank 80 for the liquid is shown independently carried in the upper part of the floor stand on a level spaced at all points a predetermined safe distance below the bottom of the floor pan wall 28 which serves in closing off the bottom of the chamber 24. From a filter 82 supported within the tank 80, an interconnecting suction conduit 84 leads to the inlet side of the pump 72.

A multipart drain line structure 86 which will be hereinafter described in detail interconnects the reservoir tank 80 and the floor pan wall 28 for handling the drainage from the latter, now to be explained. Each of the legs on the stand 11, such as the right front leg 12 which is typical, stands on a threadedly adjustable foot 88; then according to installation instructions contemplated to be furnished with each washer, the foot 88 is slightly extended to make leg 12 slightly the longest, whereas legs 14 and 18 are made somewhat shorter and the diagonally opposite left rear leg 16 becomes the shortest, all solidly on a level floor.

FLOOR PAN DRAINAGE—FIGS. 2, 3

The unequal adjustment just described of the legs of the floor stand 11, though hardly perceptible to the eye, produces a definite slope to the floor pan wall 28 from a high point at the right front corner 90 down to the low point 92 in the left rear corner which will be seen in these figures to be occupied by the drain line structure fragmentarily appearing at 86. Consequently, some portions of the liquid runoff will drain alongside the walls rectilinearly in the direction of the respective right angle arrows 94 and 96, whereas the major flow will be diagonally across the pan in the direction of the arrow 98, all without allowing runoff to puddle or otherwise accumulate but instead to immediately drain from the pan.

The comparatively extended adjustment illustrated in FIG. 1 at 88 presumes a level floor beneath the floor stand 11 and is somewhat exaggerated as shown; however, the feet for all legs provide a considerable range of longitudinal adjustment so that on uneven flooring the leg 12 is effectively the longest from the level standpoint. The true horizontal plane appears at 100 in FIG. 3, out of which the canted wall 28 is shown upwardly tilted as evidenced by the right front corner 90 being in the desired way at the high point for good, gravity directed runoff.

FORCED LIQUID CIRCULATION—FIG. 4

In their locations on opposite vertical sides of the air space 102 by which they are kept forcibly separated, the chamber 24 at the bottom is maintained sealed apart by the wall 28 and the reservoir chamber 104 at the top is maintained sealed apart by the impervious reservoir cover 106. A fill opening cap 108 tightly closes off a fill opening in the cover and a drain plug 110 tightly closes off a drain opening in the bottom wall of the reservoir 80.

In structure 86, a drain trap 112 is provided therefor of familiar plumbing U-shape; in the usual way, the trap holds itself continually full of liquid. At the lowest base point in the bend therein, the trap 112 has a depending vertical extension 114 which, when unplugged as provided for at the bottom, allows metal chips and an accumulation of grit and other particles which sink down out of the liquid to be periodically removed from the liquid system.

Connected to the upstanding legs of the drain trap 112 at opposed points both above the liquid level, a tank vent 116 provided with small diameter restrictions at opposite ends bridges across the top of the trap 112. No wire mesh or other screening is required for its function as a fire barrier because of equal effectiveness of the smallness of tandem restrictions in that function; so the interior of the reservoir chamber 104 readily vents off any accumulated vapor or pressure into and up and out of the throat 118 of the drain line structure 86. The thus bypassed drain trap 112 conducts the flow of liquid only, and only in the direction of the reservoir tank 80 in which is is kept in storage available to be pumped out.

A drain plug arm 120 is supported on the end wall 32 by a pivot bracket 122 for pivoting between an upstanding position, not shown, and a limiting horizontal position which as illustrated overlies the mouth of the drain line structure 86. A drain plug 124 suspended in spaced apart relation within the mouth much like an unseated poppet valve is connected at the top by a heat fusible link 126 to the arm 120 for support. The drain plug 24 is connected at the bottom by a highly stretchable tension spring 128 to a strainer basket 130 detachably secured inside the throat of the drain line structure 86.

Raising the arm 120 upwardly on its pivot bracket 122 will cause the spring 120 to stretch sufficiently that it can be unhooked at either the end connected to the strainer basket 130 which ordinarily stays in place or the end connected to the plug 124 being withdrawn from the mouth of the drain. Made accessible in this way, the basket 130 can be detached, from where secured in the throat, and then emptied. The basket 130 strains out only the largest particles and the normal suspended position of the plug 124 allows space all around for the largest particles to pass into the mouth of the drain line structure 86.

All liquid which the pump 72 causes to be discharged by the nozzle 44 eventually makes its way back from the chamber 24, thence through the drain structure 86, and into storage in the tank 80 so as to be available again for the pump 72.

FORCED INTERNAL ATMOSPHERE CIRCULATION—FIGS. 5, 6

A wire grille 132 covers the inlet 134 to the tower 62 which, on the inlet's outer side, carries a liquid agglomerating filter 136 behind the grille 132 and which, on the inlet's inner side, carries the communicating tower scroll housing 138 containing the blower rotor cage 140. A motor shaft 142 passing from the blower motor 60 through a shaft seal 144 in wall 36 supports the blower cage 140 for high speed rotation causing the internal atmosphere of the spray chamber to be drawn through the filter 136 in the inlet 134 in the direction indicated by a suction arrow and then be forced down the blower tower 62 in the vertical direction of the arrows shown therein.

Cleaning-liquid fog is extracted from the chamber's internal atmosphere by the agglomerating filter 136; a good part of the thus separated liquid in the filter agglomerates as droplets or drops in a drip hole 146 at the bottom of the filter 136 so as to fall in the chamber in a side path it takes which I indicate generally at 148 and which I shall designate the *2d* crossover path.

The remainder of the agglomerate spills out the face of the filter 136 on the inner side so as to go down the inside of the blower tower 62 in a *3d* crossover path generally indicated at 150, either by free fall as drops or droplets or by dripping or running down along the inside wall of the tower and out through a drip hole.

CROSSOVER—FIG. 7

Although the just preceding discussion of air-blower forced circulation was presented separately and independently from a prior appearing discussion of pump forced liquid circulation, the stringently confined paths of these two closed circulation systems establish cooperation and have three common portions contained within the confines of the spray chamber 24. The essentially air-tight integrity of the surrounding cabinet fregmentarily shown in FIG. 7 at 22 will insure a leak-free internal air path schematically indicated at 152 and a leak-free liquid path schematically fragmentarily indicated at 154.

High pressure pump spray 156 along path 154 can be selectively directed by the gloved hands of the operator at the work W supported in the chamber 24, for example, directed at the housing of an automotive power steering pump requiring grit and grime and an oily film to be stripped off. The cleaning liquid runoff 158 along sloping path 154 carries with it the impact-dislodged grit and grime plus the solute therein from the clinging oil and dirt film dissolved by the liquid off the work W.

Splash and splatter of the extremely fast moving spray particles being stopped by the work W produce continuous mist from the cleaning liquid which, in a common portion of travel shared by the circulating liquid and air, transfers as a fog in a 1st crossover path 160 into entrainment in the chamber's circulating internal atmosphere.

Simultaneously, continuous agglomerate being recovered by the filter 136 is in part following the *2d* crossover path 148 and in part following the *3d* crossover path so that the two parts can combine and together be reunited with their parent stream of liquid runoff 158 at a floor pan juncture schematically appearing at 162. This common portion of travel shared by the circulating liquid and air makes possible the complete return for re-use of all cleaning liquid applied, and as one body it enters and pours down the drain line structure 86.

In the ordinary case, the continual stripping, by filtration, of the rising mist from the air almost as soon as it forms therein never allows the vapor concentration to run high enough for fogging over the operator's viewing window 40 in the console, not shown. However, problem cases can arise where a nonflammable hotter cleaning spray is desired as with a detergent-action cleaning powder in water, or where the cleaning liquid employed is some petroleum based solvent having, even without heating, an inherently high vapor pressure. Further means of preventing steaming from the water, misting, and other fogging are provided in the practice of my invention.

MODIFIED EMBODIMENT—FIGS. 8, 9

Illustrative of one such means is the modified embodiment of the invention as shown in these figures. Within the environment of the machine 20 already described and equipped with a floor stand 11, the modification occurring is made to the blower tower 62*a* to enable the machine to perform with normal effectiveness even under the most stringent operating condition of window fogging. In place of being precisely vertical as before, the tower 62*a* as it runs alongside end wall 36 could be more properly described as horizontal, in its generally diagonal or atilt disposition as it extends forwardly toward its outlet 66 near the front right side of the machine. The tower 62*a* thus lies essentially in the vertical plane containing the right edge of the window 40, being below that edge and spaced parallel thereto and to the plane of the glass. The agglomerate drip follows, as before, the *2d* and *3d* respective crossover paths 148 and 150.

The outlet 66 and window 40 are essentially transversely aligned across the width dimension of the machine, and the generally horizontally disposed louvers or vanes 64 are angled in the outlet for a slight nozzle uptilt direction to cross-discharge the vapor-ridded air from the outlet 66 onto and then alongside the inner face of the glass 40. Although the scouring effect is akin to action expected from an automotive defogging and defrosting nozzle, the effect is moreso here because the cleaning-liquid fog-removal in this instance changes the actual character of the air being blown which is clear and is ridded of its fog contents. So the window surface is being dried by the scrubbing thereof with an undistorting, forced blanket of processed drying air, as well as being undistortedly air-curtained off from having a stagnant layer of foggy air settling in and misting up the underside.

CLEANING LIQUID

Cleaning liquids of a wide assortment are satisfactory for use in the present machine, and they commercially vary in composition according to the character of the industry in which they are utilized. Low bubbling soap/detergent solutions can be effectively applied by the machine to the different parts requiring washing in various shops or the like. In the bakery industry, by way of a highly stringent example, a low sudsing, heated detergent solution under the strong spraying power hereof can readily scour off the baking pans; when needed, an electric heating coil is installed in the reservoir tank of the machine to keep the solution warmed to the desired wash water temperature at all times.

In one preferred use of the machine which is as a parts washer found so convenient to garage and other mechanics the regular parts washer liquid can be just as effectively employed, usually consisting of a petroleum based cleaning solvent. It is essential that the petroleum constituent have a high flash point, and a value of 104° F. and higher is not uncommon in the petroleum based solvents found in washers in the usual service and machine shops and repair garages. In many, the brand used currently and found altogether acceptable is Stoddard petroleum solvent produced by Safety-Kleen Company. Another suitable proprietary brand, made available through its distributors in many if not most states within continental USA by one maker of assorted cleaning products, Graymills Corporation, Chicago, Ill., is Graymills Super Agitene cleaning solvent or, also suitably, Graymills 571 both of which are familiar to the trade. Most will in my machine have the tendency under impetus of the high pressure impact to create a "wet" atmosphere, which is the problem confronted even with petroleum solvents at room temperature and surmounted herein. And of course it is no solution to the problem to allow positive internal air pressure to develop because of fume problems; the present machine never develops pressure inside and hence has no tendency to force fumes out in the air.

In other words, in non-analagous devices such as transpires in air blast, sand blast, and water blast machines, as the machine continues in periods of operation, the air or sand or water admitted continues to increase as a displacing volume inside, inevitably building up pressure therein which makes its way directly to the outside. As already noted in connection with the instant parts washer, solvent emitted by the spray nozzle then goes through one path or another eventually all to return to the pump for recirculation. And all air drawn into the blower tower inlet is, upon drying, immediately thereafter readmitted in total back into the spray chamber whence it came. There is no net gain and no net loss in volume, and hence nothing to give rise to an internal pressure buildup which will expel fumes.

AIR FILTER

The specifications for the agglomerating filter are not rigid in the least; it works to full effectiveness as soon as all surfaces are wetted by the liquid and in one satisfactory working form was a ¼" thick, 5" diameter closely knit pad of thin, chemically inert fibres. The film on the fully wetted surface areas thereof is continually fed by impacting fog particles, such as from the saturated steam of the usual water-mixes.

Fiberglas fibre is suitable for the knit pad material and so is zinc coated steel mesh, particularly when a petroleum solvent solution is being filtered out. For better efficiency the thickness can be increased to ½", and further satisfactory materials include foam rubber, paper filter material such as found in the air intake cleaner and silencer for automobiles, foam polyurethane material, and aluminum fine mesh.

OPERATION

As an example of the level of operating pressure I am referring to as a high pressure operation, the pump discharges at 1,100 psi in one generally satisfactory embodiment which has been built of the invention. In the main, pumps matched in capacity and outlet pressure to the nozzle to be employed would discharge in the broad range of 400 psi to 2,000 psi, whereas the preferred operating range for pressure delivered to the nozzle would be somewhere approximately from 1,000 psi to 1,500 psi. The glove box gloves loom as especially attractive built-in attachments because of these exceptionally high nozzle velocities which result, as compared for example with so-called flushing machines for cleaning in which the advertised pressure on the nozzle has a stated range of 400 psi to 600 psi.

Because of the stripping effect of solvent herein under a discharge pressure of 1,100 psi, for example, no brushing is ordinarily required; with the part in or at least manipulated by one gloved hand and the nozzle in the other, the operator exposes the interior and exterior surfaces of the part to direct force of the spray so as to dislodge the loose and clinging matter and dissolve deposited layers, films, and coats such as lubricant of which the part is to be ridded. Full force spraying will continue as long as the operator's foot presses the foot switch.

In a reversal of all steps of the foregoing procedure, the operator releases the foot switch, extricates his hands and forearms from the gloves, opens the door and, among other things, extricates the completely spray cleaned part. Additionally as I insist in my own operations, the part is then washed by hand in regular hot water and suds, rinsed off, and dried if a ball bearing, for example, the bearing thus carrying with it no residual film of petroleum solvent to interfere with the surfaces thereafter directly establishing intimate wetted contact with lubricant when being recoated for reinstallation.

Although each and every one of machines coming off the production line embodying my invention may not be so perfectly sealed that no vapors can come out, such machines can generally be considered as fume-tight if not literally so; escaping petroleum fumes in heavy concentration in the outside air will in circumstances render the solvent a fire hazard, not good to breathe, possibly explosive, and a problem because of coating things in buildings.

UNUSUAL CIRCUMSTANCES

If, under such a remote possibility that it is difficult to imagine, the machine door happens to be open when a flying spark or open flame or naked electrical spark happens about, the door under gravity will slam shut and relatch immediately it is released to close. So any accumulation of random vapors in the spray chamber which could have ignited prior to door closure would promptly burn themselves out as the limited supply of chamber oxygen was exhausted because of the sealed off chamber being atmosphere-tight to the oxygen supply in the air outside. It is doubtful the liquid film or droplets on the interior surfaces could evaporate in the short period ensuing.

If, under an even more remote possibility, the circumstances were such that either the low concentration of solvent vapor in the chamber atmosphere or solvent liquid flow in the chamber making its way expeditiously to drain were somehow to erupt in flames, right during a spraying operation, the fire could never spread beyond being a sealed off internal one and would promptly snuff out. Four added factors would automatically or inherently contribute to the extinguishing of the fire as the internal supply of oxygen was fast being depleted. First, the blower tower would be removing spent combustion products and also solvent mist before it ever ignited, and then be pouring back toward the fire in the chamber air carrying a mixed-in heavy concentration of dry combustion products which would dilute the remaining air and tend to blanket and smother flames. Second, the U-shaped drain trap would furnish a fire barrier at the top with the restricted vent thereacross, and require enough continuous oxygen so as to continuously burn out all solvent trapped down and around in the U; and otherwise, there is no path available for fire to reach the solvent reservoir tank spaced as it is safely below the floor pan of the chamber. Third, heat from combustion going on in the drain line throat below or in the chamber adjacent the mouth of the drain line would melt the fusible link holding open the plug in the mouth; unopposed bias from the tension spring connected to the bottom of the plug would snap the plug down shut, completely isolating the spray chamber and any avenue for the fire to escape and spread. Fourth, not only would oxygen and highly diluted vapor be extremely scarce in their availability in the chamber, but also the rapid runoff being accomplished by the sloping floor pan would insure no pool or pocket of solvent could be present in the chamber to feed a fire. So the life of any such fire would be extremely short, and always confined within the sealed integrity of the system.

A pump particularly well suited to the practice of this invention has not only the characteristic of delivering the referred to continuous high pressure to the spray nozzle, but equally the characteristic of delivering a continuous high rate of flow as compared to the usual low capacity pumps of parts washers in general. In practice, a pump capacity of 3.5 gallons per minute continuously delivered under high pressure has proved satisfactory for the high rate, nozzle discharge velocities required herein. And it has been found here that volume of spray flow can be altogether adequately supplied from a relatively moderately sized reservoir in a particular form of my invention, which is a preferred form for that reason and will now be explained.

PREFERRED EMBODIMENT—FIGS. 10, 11

In this embodiment, the floor pan wall 28 is cut out at the center to form a large rectangular drain opening 164 and, at the rectangular outer edges, is formed as a base tray carrying a continuous short upstanding flange 166. The chamber side walls including the left end wall 32, the back side wall 34, and right end wall 36 join the floor pan wall 28 in tightly overlapping relation with the base tray flange 166 which is on the outside.

A continuous bracket 168 made of a Z-shaped metal strip overlaps with the entire underside edge of the rectangular drain opening 164 so as to form at an upper bracket level a fixed shelf 170, or ledge, receiving a rectangular removable work surface 172 which in effect completes the base tray and is in the plane thereof. The surface 172 is presented by a metal support plate formed with a pattern of regularly spaced apart, large perforations 174 therethrough.

At a lower bracket level the strip forms a continuous, slightly inwardly offset rectangular fixed shelf 76 or ledge which complementarily receives the short, horizontal lateral supporting flange 178 of a close meshed, wire filter basket 180.

The work surface 172 presented by the support plate is useful during the spray cleaning of a part. So the plate stays in place as illustrated while the operator has his hands and forearms working in the built-in gloves, not shown.

But when no spraying is going on, the support plate does not always stay in the machine. It is usually but not necessarily removed in order to refill the tank 80*a* following a draining and cleaning out upon removal of the drain cap 110. The support plate is removed in order to lift out and empty the basket 180 of collected sludge, debris, trash, and other residue from the vigorous spray cleaning, as compared to the simple flushing off of parts by prior parts washers. Also the support plate is removed when the solvent level is high enough in tank 80*a* to immerse the basket 180 and allow the machine to be used as a quiescent soak tank for parts.

SPECIFICATIONS AND OPERATION—FIGS. 10, 11

In one physically constructed embodiment of the invention, the base tray around the outside as delineated by the upright flange 166 had a rectangular measurement of 26" on the short side by 34" on the side across the width of the machine. The horizontal surfaces shown in plan view in FIG. 10 were all level.

During spraying, the downflow capacity of the number of perforations 174 in aggregate over the entire area of the work surface 172 was more than adequate to drain off the 3.5 gpm runoff of solvent liquid; the side wall and bottom area of the filter basket 180 in total was more than equal to settling out the sludge and returning the solvent as filtered liquid to the reservoir 80*a* for re-pumping. Upon each re-start of spraying, it was found that a mere residual volume of 5 gallons of solvent in the tank 80*a* was sufficient both for the start-up and for the continual run of spraying sustained at 3.5 gpm.

The spray delivery rate of the embodiment as shown in FIGS. 10 and 11 has proved exceptionally high in the general class of parts washers, despite its construction being at once simplified, compact, easily maintained, and fairly foolproof and straightforward in operation. Brushing to dislodge caked-on oil, grease, grit, and grime is practically unheard of, and the force of impact of the spray jet does the effective surface stripping and scouring necessary. And, as previously indicated, the tight integrity of the spray chamber and rest of the system negates any problem of outleak of the mist coming off the spray jet impact area.

By way of the synergism involved with a parts cleaning practice according to the foregoing, it will be appreciated that my invention provides, as a step within a glassed-machine enclosure, the processing of the internally circulating atmosphere so as to desaturate the air for recovery of the steam emanated from the cleaning liquid, resulting in a vapor-ridded atmosphere ideal for forced circulation as processed air to defog glass in the machine, resulting in a desaturated, non-distorting covering blanket active to block off or scrub away stagnant steam or fog from filming over the glass, resulting in precise glove manipulation and accurate exposure by eye of all areas of the parts to the stripping action of spray impact, resulting in parts fully clean to the view, even while the cleaning is still in process and without any preceding steps necessarily, such as separately brushing the parts initially to dislodge or loosen whatever is adhering.

Variations within the spirit and scope of the invention described are equally comprehended by the foregoing description.

What is claimed is:

1. High pressure process, utilizing liquid spray and runoff, for cleaning by eye in a glove box machine having a sealed transparent viewing window susceptive to fogging, and sealed glove box gloves extending therebelow into the machine for manipulating parts therein, said machine providing a closed system for high pressure hand spraying of parts to be cleaned in a fully enclosed spray chamber of essentially vapor tight integrity, said chamber by the integrity of its enclosure defining a confined spray chamber atmosphere, and said process employing a prepared cleaning liquid from which splash-induced spray accumulates to a high vapor concentration in the confined spray chamber atmosphere, comprising the steps of:

forced blowing (140) in the machine of the atmosphere of the chamber in an internal path of closed cycle recirculation for recycling same by blower, characterized by effectively filtering and clearing in an internal blower tower the atmosphere from its entrained spray vapor to limit and dilute the vapor to reduced concentration in a filter ahead of the tower, and directing the vapor-ridded clear atmosphere across an adjacent surface of the viewing window so as to impinge same with a forced blanket of recycled drying air and to air-curtain off same from having a stagnant layer of foggy air nestling in and misting over said surface of the viewing window;

simultaneous forced pumping (72) through the machine of the cleaning liquid in another path of closed cycle recirculation for recycling same by pump and effectively glove-manipulating (52,54) the chamber parts so as to expose all areas of the parts and subject them to forced pressure spraying of said cleaning liquid thereupon and resulting runoff and spray emanating in the chamber therefrom;

simultaneously effecting crossover in a 1st crossover path of vapor rising from spray in the liquid path into entrainment in the atmosphere path, all because of overlap in operation of the several steps recited and all within the closed confines of said enclosure; and simultaneously effecting crossover in a liquid crossover path of liquid agglomerate collected by the filter from the atmosphere path and reunited through the liquid crossover path with the liquid runoff in the liquid path, all because of the overlap in operation of all steps recited and all within the closed confines of said enclosure.

2. The invention of claim 1, the last named crossover path affording crossover characterized by:

simultaneously effecting crossover in a 2*d* crossover path (148) of liquid agglomerate dripover draining from a filter drip hole into reunion with the liquid of the runoff in the liquid path.

3. The invention of claim 2, further characterized by:

simultaneously effecting crossover in a 3*d* crossover path (150) of liquid agglomerate spillover of the filter into the internal blower tower and draining therefrom into reunion with the liquid of the runoff in the liquid path.

4. The invention of claim 1, the cleaning liquid which as prepared produces the indicated runoff and vapor rise-off: characterized in composition by a prepared water mix, further characterized by a detergent water mix, and additionally characterized by a heated water mix; and the rise-off vapor thereof consisting essentially of saturated steam from which the internal atmosphere is being de-saturated.

5. High pressure process utilizing spray and runoff for the cleaning, by eye in a glove box machine, of articles to be cleaned when enclosed in the machine and by means of pressurized liquid, said machine having a sealed transparent viewing window susceptive to fogging, and sealed glove box gloves extending therebelow into the machine for manipulating said articles therein, said machine providing by closed system a fully enclosed spray chamber of essentially vapor tight integrity, said chamber by the integrity of its enclosure defining a spray chamber atmosphere, and said process employing a prepared cleaning liquid from which splash-induced spray accumulates to a high vapor concentration in the thus confined spray chamber atmosphere, comprising the steps of:

impinging on an article exposed in all areas by glove-manipulation a high pressure spray of the prepared cleaning liquid in the machine producing floor runoff (158) from the high pressure spray and producing vapor rise-off (160) from the high pressure spray;

simultaneous forced blowing (140) in the machine of the atmosphere thereof in an internal path of closed cycle recirculation for recycling same by blower, effectively causing vapor-to-liquid agglomeration and separation by filtering (136) the atmosphere of its entrained vapor while on the upstream side of the blower, and directing the vapor-ridded clear atmosphere across an adjacent side of the viewing window so as to impinge same with a forced blanket of recycled drying air to defog the viewing window and to air-curtain off same from having a stagnant layer of foggy air nestling in and misting up the adjacent side thereof;

simultaneous forced pumping (72) through the machine of the cleaning liquid thereof in a path of closed cycle recirculation for recycling same by pump and effectively filtering (82) the liquid of washed-off contaminant while on the upstream side of the pump; and simultaneously directing the path for the atmosphere's closed cycle and the path for the liquid's closed cycle so as to flow through an area in common, the common area completely enclosed by the enclosure (22) and accommodating crossover (160) of the vapor from the liquid path into the atmosphere path for admission into, and separation from atmosphere entrainment in a vapor-to-liquid agglomerating filter (136) located relatively upstream in the forced blown atmosphere path, all because of the overlap in operation of all steps recited.

6. High pressure process of machine spraying according to claim 5, further comprising:

simultaneously directing the vapor-to-liquid agglomerate, as filtered, to flow into the floor runoff for crossover and refiltering and repumping re-united with the liquid's recirculation path.

7. High pressure process of machine spraying in accordance with claim 5, and with the pressurized liquid characterized by:

a steam liberating heated water solution of low sudsing detergent.

8. High pressure process of machine spraying in accordance with claim 5, wherein the cleaning liquid is gravity reservoired below a floor runoff zone comprising the further steps of:

sensing and responding to a fire in the floor runoff zone of said enclosure; and automatically blocking off the reservoired liquid from the floor runoff zone in response to a sensed fire.

9. High pressure process utilizing spray and runoff for the cleaning, by eye in a glove box machine, of articles to be cleaned when enclosed in the machine and by means of pressurized liquid, said machine having a sealed transparent viewing window susceptive to fogging, and sealed glove box gloves extending therebelow into the machine for manipulating said articles therein, said machine providing by closed system a fully enclosed spray chamber of essentially vapor tight integrity, said chamber by the integrity of its enclosure defining a spray chamber atmosphere, and said process employing a prepared cleaning liquid from which splash-induced spray accumulates to a high vapor concentration in the thus confined spray chamber atmosphere, comprising the steps of:

directing onto the article a high pressure spray of the prepared cleaning liquid in the machine producing floor runoff from the high pressure spray, and producing vapor rise-off from the high pressure spray;

simultaneous glove-manipulation of the article and by eye exposing all areas thereof to said high pressure spray;

simultaneous forced blowing in the machine of the atmosphere thereof, in an internal path of closed cycle recirculation for recycling same by blower, effectively causing vapor-to-liquid agglomeration and separation by filtering the atmosphere of its entrained vapor while on the upstream side of the blower, and directing the vapor-ridded atmosphere across an adjacent side of the viewing window so as to impinge same with a clear forced blanket of recycled drying air to defog the viewing window and to air-curtain off same from having a stagnant layer of foggy air nestling in and misting up the adjacent side thereof; and simultaneously affording a space of confluent flow between the path for the atmosphere's closed cycle and the flow of vapor rise-off through an area in common, the common area completely enclosed by the enclosure and accommodating crossover of the vapor into the atmosphere path for admission into, and separation from atmosphere entrainment in, a vapor-to-liquid agglomerating filter located relatively upstream in the forced blown atmosphere path, all because of the overlap in operation of all steps recited.

10. The invention of claim 9, the cleaning liquid which as prepared produces the indicated runoff and vapor rise-off: characterized in composition by a prepared water mix, further characterized by a detergent water mix, and additionally characterized by a heated water mix; and the rise-off vapor thereof consisting essentially of saturated steam from which the internal atmosphere is being de-saturated.

11. The invention of claim 10 characterized by the further step of:

simultaneous forced pumping through the machine of the heated water-mix detergent liquid in a path of closed cycle recirculation for recycling same by pump and effectively filtering the heated water-mix detergent of washed-off contaminant while on the upstream side of the pump.

12. The invention of claim 9, further comprising the step of:

simultaneously directing the vapor-to-liquid agglomerate, as filtered and separated out, to flow into said runoff thereby re-uniting the liquid of the agglomerate with the floor runoff liquid.

13. The invention of claim 12 wherein the prepared cleaning liquid is gravity reservoired below a floor runoff zone, additionally comprising the steps of:

sensing and responding to fire in the floor runoff zone of said enclosure; and automatically sealing off the reservoired liquid from said floor runoff zone in response to a sensed fire.

* * * * *